United States Patent [19]

Tomita et al.

[11] Patent Number: 4,577,564

[45] Date of Patent: Mar. 25, 1986

[54] APPARATUS FOR FEEDING WASTE TIRE CHIPS

[75] Inventors: Yukio Tomita, Osaka; Kenjiro Nabeshima, Kobe; Nobuji Shibamoto, Nara, all of Japan

[73] Assignee: Hitachi Zosen Corporation, Osaka, Japan

[21] Appl. No.: 692,388

[22] Filed: Jan. 17, 1985

[51] Int. Cl.[4] ..... F23K 3/14; F23K 3/16

[52] U.S. Cl. ..... 110/110; 110/255; 110/257; 198/672; 198/676; 414/158

[58] Field of Search ..... 110/110, 255, 257; 198/672, 676; 414/158

[56] References Cited

U.S. PATENT DOCUMENTS 371,609 10/1887 Marr ..... 198/672
1,746,350 2/1930 Hayn ..... 110/110
1,991,842 2/1935 Burton ..... 110/110
2,177,179 10/1939 Hendershott et al. ..... 198/676
2,414,536 1/1947 Kirk ..... 198/676

*Primary Examiner*—Edward G. Favors
*Attorney, Agent, or Firm*—Joseph W. Farley

[57] ABSTRACT

An apparatus for feeding waste tire chips to an incinerator comprises a chip container having a front wall, a rear wall and an outlet at the lower end of the front wall, and a screw feeder having a shaftless helical screw blade provided at an inner bottom portion of the container. The screw blade has one end supported by a first bearing provided on the rear wall of the container and the other end projecting from the outlet of the container. The other end of the screw blade is supported by a second bearing disposed outside the container outlet. Waste tire chips can be fed to the incinerator stably at all times.

6 Claims, 5 Drawing Figures

APPARATUS FOR FEEDING WASTE TIRE CHIPS

The present invention relates to an apparatus for feeding waste tire chips to an incinerator.

Presently, waste tires are broken into numerous chips by a crusher and then placed into an incinerator by a feeding apparatus in a specified amount at a time for incineration and also for the recovery of heat.

Typically, conventional apparatus for feeding waste tire chips comprise a container having a front wall and a rear wall for containing waste tire chips, and a screw feeder having a helical screw blade and disposed in a transport channel of substantially U-shaped cross section which is formed at the bottom of the container. The container front wall has connected to its lower end a discharge duct communicating with the transport channel and extending to the feed inlet of the incinerator. The screw blade, which extends into the discharge duct, has one end supported by a bearing on the container rear wall and the other end positioned within the discharge duct as a free end.

With the feeding apparatus of the above construction, the discharge duct guides waste tire chips to the feed inlet of the incinerator and serves to protect the other end of the screw blade from excessive bending. However, when the chips descending along the container front wall join those sent forward through the transport channel from the container rear wall toward the front wall by the screw blade which is drivingly rotated, an excessive amount of chips enter the discharge duct, possibly plugging the duct and exerting an excessive load on the drive unit for the screw blade.

In view of the above drawback of conventional apparatus, an object of the present invention is to provide an apparatus for feeding waste tire chips to an incinerator stably at all times.

To fulfill this object, the present invention provides an apparatus for feeding waste tire chips to an incinerator which apparatus comprises a chip container having a front wall, a rear wall and an outlet at the lower end of the front wall, and a screw feeder having a shaftless helical screw blade provided at an inner bottom portion of the container, the screw blade having one end supported by a first bearing provided on the rear wall of the container and the other end projecting from the outlet of the container, the other end of the screw blade being supported by a second bearing disposed outside the container outlet.

The apparatus of the invention described does not include the discharge duct connected to the lower end of the container front wall of the conventional apparatus. This eliminates the plugging of such a discharge duct with chips and further precludes the overloading of the screw blade. Additionally, the second bearing (which may permit displacement of the blade end within a predetermined range) prevents excessive displacement of the other end of the screw blade projecting from the container outlet to assure stable supply of waste tire chips at all times.

Various features and advantages of the present invention will be readily understood from the embodiments to be described below with reference to the accompanying drawings, in which.

Figure 1:
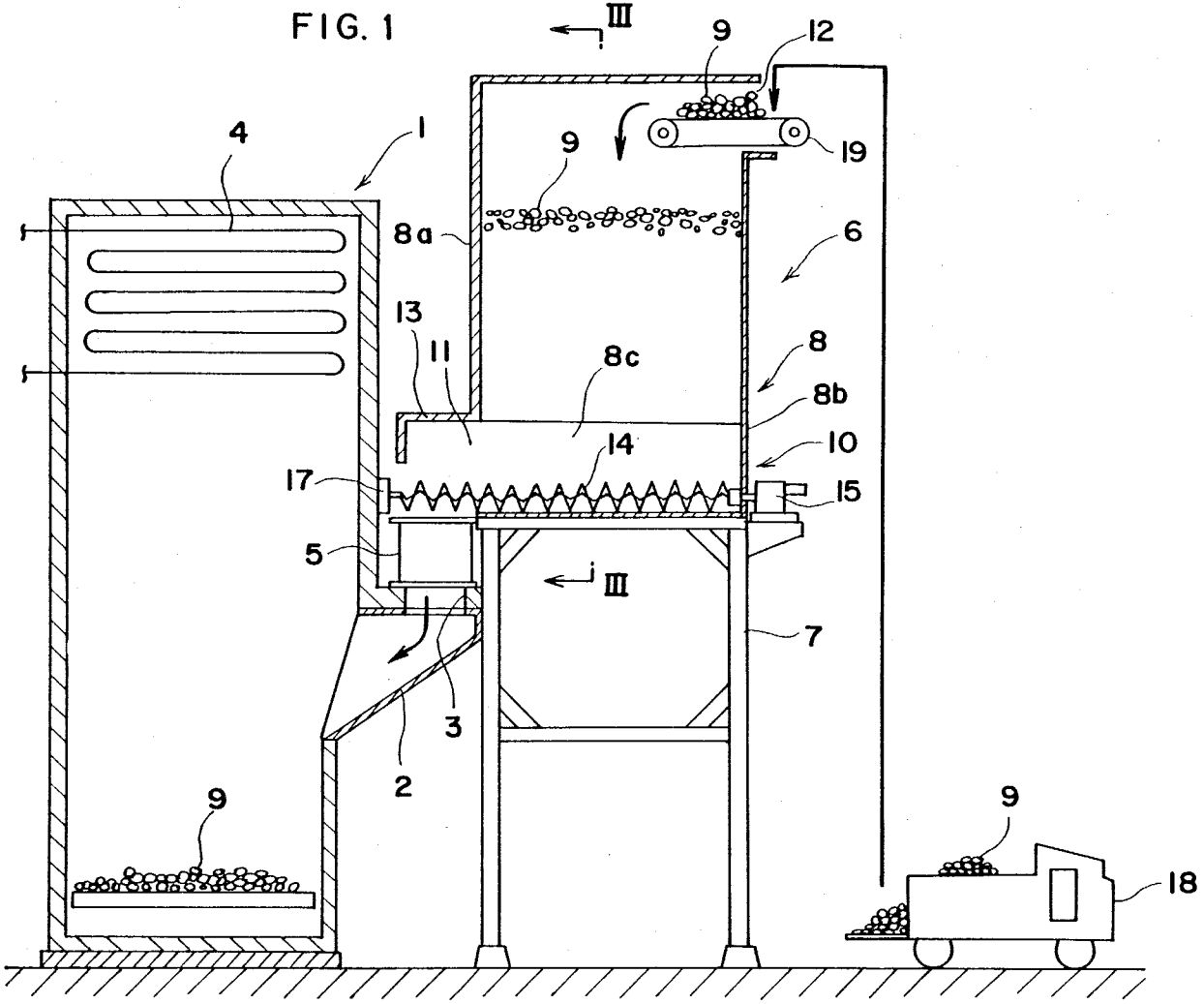
FIG. 1 is an overall side elevation in section showing a waste tire chip feeding apparatus embodying the present invention along with an incinerator.
Figure 2:
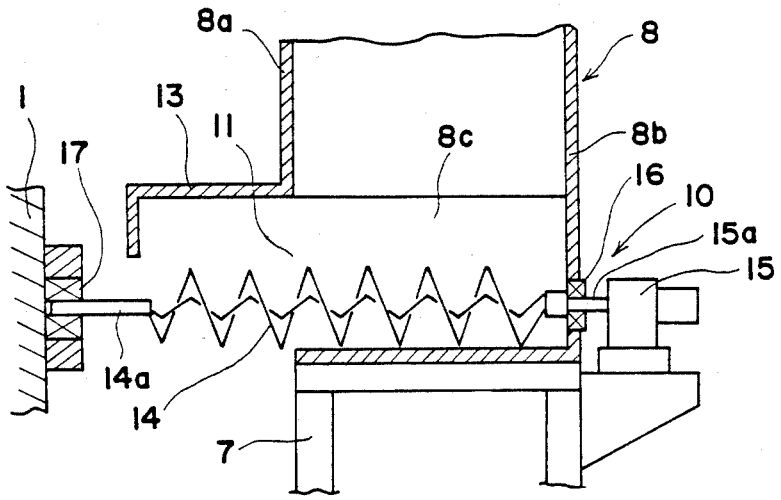
FIG. 2 is an enlarged fragmentary side elevation in section showing the feeding apparatus.
Figure 3:
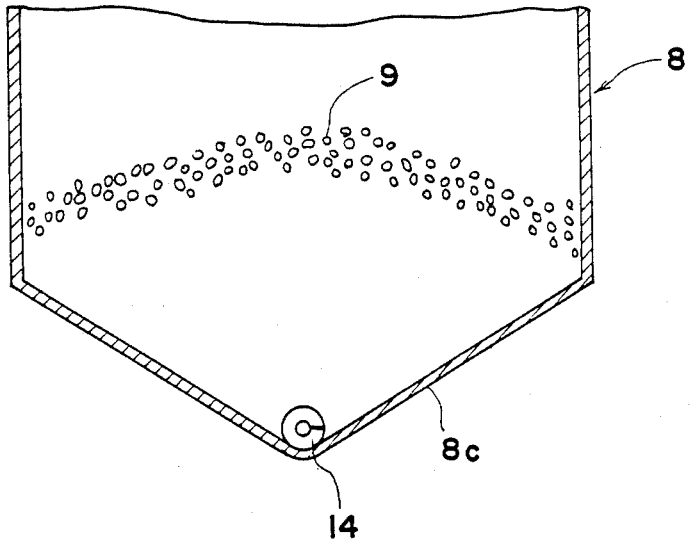
FIG. 3 is a view in section taken along the line III—III in FIG. 1.

With reference to FIGS. 1 to 3, an incinerator 1 is provided, at one side of an intermediate portion thereof, with a feed chute 2 having a feed inlet 3. The incinerator 1 is equipped at its upper portion with a heat exchanger 4 for recovering the heat of combustion produced within the incinerator 1. The feed inlet 3 of the chute 2 is provided with a metering device 5. Disposed adjacent the incinerator 1 is a waste tire chip feeding apparatus 6 mounted on a support frame 7.

The feeding apparatus 6 comprises a container 8 for containing the chips 6 obtained by cutting waste tires, for example, by a crusher, and a screw feeder 10 disposed at the bottom of the container 8. The container 8 has a front wall **8*a* adjacent to the incinerator 1 and provided with an outlet 11 at its lower end, a rear wall 8*b* away from the incinerator 1 and provided with an inlet 12 at its upper end, and a bottom wall 8*c* which is substantially V-shaped as best seen in FIG. 3. The bottom wall 8*c*, which provides a path of transport of chips 9, has an angle of inclination of 30 to 45 degrees with respect to a horizontal plane so that chips 9 can be fed smoothly and stably. The outlet 11 is provided with a guide 13 projecting from the front wall 8*a* substantially perpendicular thereto and completely open at its bottom. The screw feeder 10 comprises a shaftless helical screw blade 14 disposed within the container 8 along the bent portion of the bottom wall 8*c*, and a drive unit 15 having an output end 15*a* connected to one end of the screw blade 14 for rotating the screw blade 14. The above-mentioned end (rear end) of the screw blade 14, i.e. the output shaft 15*a* of the drive unit 15 is rotatably supported by a first bearing 16 on the container rear wall 8*b*. The front end of the screw blade 14 extends outward from the container outlet 11 and is positioned immediately above the metering device 5, i.e. the incinerator feed inlet 3. The blade front end is rotatably supported, without play, by a second bearing 17 attached to the incinerator 1, by means of a rod 14*a* of circular cross section. Indicated at 18 is a truck for transporting waste tire chips 9 to the feeding apparatus 6. By suitable means, the chips 9 are transferred upward from the truck 18 to a conveyor 19 which is installed at the container inlet 12 for supplying the chips to the container 8**.

With the apparatus described above, the chips 9 in the container 8 are conveyed along the bent portion of the bottom wall **8*c* in the direction from the container rear wall 8*b* toward the front wall 8*a* by the screw blade 14 which is drivingly rotated by the drive unit 15 and are then fed to the metering device 5 through the outlet 11. Even if the amount of discharge of chips 9 increases at this time, the chips will not plug the outlet 11 but smoothly pass therethrough without overloading the drive unit 15 or the screw blade 14, because the outlet 11 is not provided with the discharge duct conventionally used. Furthermore, the second bearing 17 prevents excessive deformation of the screw blade 14**.

Chips 9 are placed into the incinerator 1 through the chute 2 in a specified amount at a time, as measured out by the metering device 5, and are incinerated. The heat of combustion produced is recovered by the heat exchanger 4 and utilized for a suitable purpose.

Figure 4:
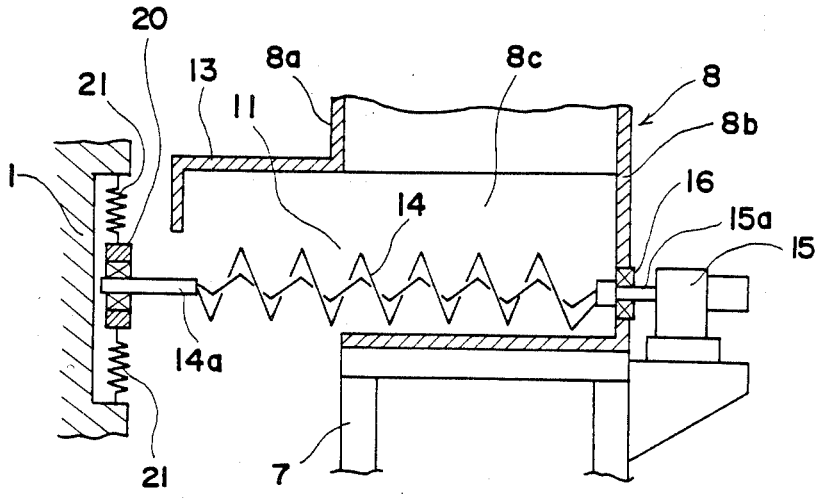
FIG. 4 is a fragmentary side elevation in section showing another embodiment of the invention.

FIG. 4 shows another embodiment, in which a second bearing 20 is resiliently attached to the incinerator 1 by a pair of springs 21 for biasing the bearing 20 in opposite directions, and the rod 14*a* attached to the front end of the screw blade 14 is supported by the bearing 20. Accordingly, the rod 14*a* can be displaced axially and radially within a predetermined range and is also tiltable within a predetermined range. This embodiment is advantageous in that the screw blade can oscillate slightly and is prevented from developing an excessive stress.

Figure 5:
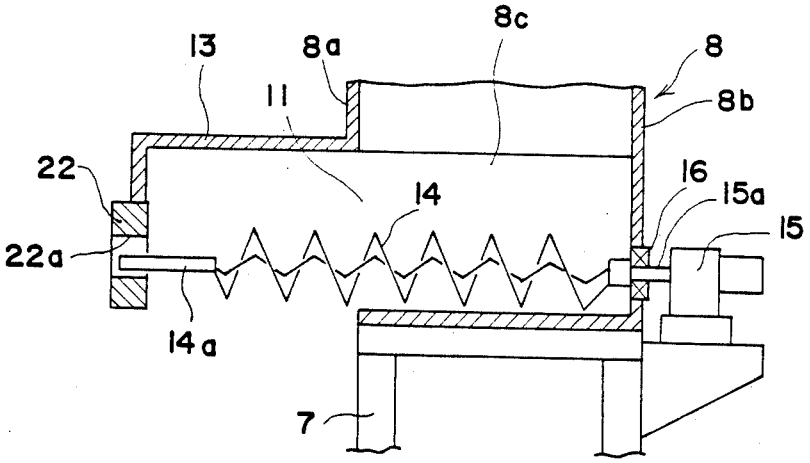
FIG. 5 is a fragmentary side elevation in section showing another embodiment of the invention.

FIG. 5 shows still another embodiment, in which a second bearing 22 attached to the guide 13 is formed with a circular bore 22*a* having a larger diameter than the rod 14*a*. This embodiment is also expected to have the same advantage as the one shown in FIG. 14 because the rod 14*a* can be displaced axially and radially and is tiltable within a predetermined range.

What is claimed is:

1. An apparatus for feeding waste tire chips to an incinerator, the apparatus comprising a chip container having a front wall, a rear wall and an outlet at the lower end of the front wall, a screw feeder having a shaftless helical screw blade provided at an inner bottom portion of the container, the screw blade having one end supported by a first bearing provided on the rear wall of the container and the other end projecting from the outlet of the container, a rod of circular cross section attached to said other end, and a second bearing rotatably supporting the rod, the second bearing being disposed outside the container outlet and being supported by and connected between a pair of springs biasing the second bearing in opposite directions whereby the rod is displaceable radially and axially within a predetermined range and is tiltable within a predetermined range.

2. An apparatus for feeding waste tire chips to an incinerator, the apparatus comprising a chip container having a front wall, a rear wall and an outlet at the lower end of the front wall, a screw feeder having a shaftless helical screw blade provided at an inner bottom portion of the container, the screw blade having one end supported by a first bearing provided on the rear wall of the container and the other end projecting from the outlet of the container, a rod of circular cross section attached to said other end, and a second bearing rotatably supporting the rod, the second bearing being disposed outside the container outlet and having a circular bore larger than the rod in diameter, the rod being positioned eccentrically within the bore so that the gap between the rod and the bore is larger above the rod than below the rod when the screw blade is in its natural state whereby the rod is displaceable radially and axially within a predetermined range and is tiltable within a predetermined range.

3. An apparatus as defined in claim 2 wherein the container outlet is provided with a guide projecting from the container front wall substantially perpendicular thereto and completely open at its bottom.

4. An apparatus as defined in claim 2 wherein the container has a bottom wall substantially V-shaped in section and having an angle of inclination of 30 to 45 degrees with respect to a horizontal plane.

5. An apparatus as defined in claim 1 wherein the container outlet is provided with a guide projecting from the container front wall substantially perpendicular thereto and completely open at its bottom.

6. An apparatus as defined in claim 1 wherein the container has a bottom wall substantially V-shaped in section and having an angle of inclination of 30 to 45 degrees with respect to a horizontal plane.

* * * * *